US005846090A

United States Patent [19]

Lu

[11] Patent Number: 5,846,090

[45] Date of Patent: Dec. 8, 1998

[54] ROTATIONAL JACK SOCKET ASSEMBLY

[76] Inventor: Ching-Shui Lu, No. 7-8, Niu-Pu-Tse, Hsing-Jen Li, Tan-Shui Chen, Taipei Hsien, Taiwan

[21] Appl. No.: 948,067

[22] Filed: Oct. 9, 1997

[51] Int. Cl.[6] ..... H01R 39/26

[52] U.S. Cl. ..... 439/26

[58] Field of Search ..... 439/20, 21, 23–26

[56] References Cited

U.S. PATENT DOCUMENTS

| | | | |
|---|---|---|---|
| Re. 32,805 | 12/1988 | Engelmore et al. | 439/26 |
| 4,764,121 | 8/1988 | Ditzig | 439/26 |
| 5,435,731 | 7/1995 | Kang | 439/26 |

*Primary Examiner*—Gary F. Paumen
*Assistant Examiner*—Briggitte R. Hammond
*Attorney, Agent, or Firm*—Beveridge, DeGrandi, Weilacher & Young, LLP

[57] ABSTRACT

The present invention relates to a rotational jack socket assembly which generally comprises a housing which has a jack socket rotationally mounted therein. The jack socket is provided will a receptacle for receiving and retaining a jack thereof The bottom of the housing is attached with a mounting bracket. The outer peripheral wall of the jack socket is alternatively enveloped with an annular terminal and an insulator. The housing is provided with a plurality of retaining holes which are corresponding to each of the annular terminals. Each of the retaining holes is further mounted with a resilient conducting loop which is provided with a plurality of projections which direct radially and inward. When each of the conducting loop is enveloped onto the outer peripheral of the housing, each of the projections can be suitably positioned within a corresponding retaining hole such that the projection is electrically contacted with the outer peripheral of the annular terminal. By this arrangement, even the jack socket is rotated, the resilient conducting loop is electrically contacted with the annular terminal. The annular ring has a continuous contour without any gap such that the poor contact can be completely avoided.

1 Claim, 5 Drawing Sheets

ROTATIONAL JACK SOCKET ASSEMBLY

FIELD OF THE INVENTION

The present invention relates to a rotational jack socket assembly, more particularly, to a rotational jack socket assembly in which the resilient conducting loop is conductively contacted with the annular terminal in a full-time manner by the projections and the conducting ring. The poor contact can be therefore avoided.

DESCRIPTION OF PRIOR ART

In the existing telephone, the handset is electrically connected with the phone base by means of a handset cord which normally has a spiral configuration. However, after a period of usage, the handset cord will be twisted into a mess and which will bring a great inconvenience to the user. On the other hand, when the handset cord is twisted, the original extension benefited from the spiral configuration is reduced. As a result, electrical connection between the jack on the cord and the jack socket on the phone base and handset will be impaired and a poor communication quality will be experienced.

In order to solve the poor communicating quality resulted from the twisting of the handset cord, a rotational jack socket is introduced, as shown in FIGS. 5 and 6. In this conventional rotational jack socket, it generally includes a clip, outer shell, rotational jack socket, annular conductor, handset jack socket and resilient conducting rod. The handset jack socket is disposed within the outer shell. The outer shell is rotationally provided with a rotational socket which has been provided with a flexible extension cord. One end of the flexible extension cord is connected with a clip. The rotational socket is further provided with a plurality of annular conductors which is configured with a crescent piercing plate and a crescent plate. The crescent piercing plate is provided with sting. Wherein when the crescent piercing plate is mounted onto the rotational socket, the sting of the piercing plate may have an electrical contact with the wire within the rotational socket. The resilient conducting rod can be pressed against onto the crescent conducting plate. The clip on the rotational socket can be connected onto the socket of the handset. Then the jack of the handset cord is inserted into the jack socket of the handset. The resilient conducting rod can be electrically contacted with the cord. On the other hand, since the resilient conducting rod is pressed onto the crescent conducting plate, as a result, an electrical conducting path can be established between the annular conductor and the resilient conducting rod. By this arrangement, even the handset cord is twisted, as the rotational socket is rotationally disposed, the twist of the handset cord can be therefore released. Consequently, the handset cord will not twist any more.

However, because the annular conductor on the rotational socket is configured by a crescent piercing plate and a crescent plate, there is a tolerance during the manufacturing process. As a result, there is a gap formed between the connecting portions. As a result, when the resilient conducting rod is rotated through this gap, a poor electric contact or even open circuit will be encountered. The communicating quality is negatively influenced.

Since the rotational socket is rotationally disposed within the outer shell, there is a gap between rotational socket and the outer shell to ensure the smooth rotation of the rotational socket. However, each time when the handset is picked up, the extension on the rotational socket will be pulled such that the rotational socket will be shied or offset such that the resilient conducting rod is pulled away from the annular conductor. As a result, a poor electrical contact as well as open circuit will also be encountered. The communication quality is also negatively influenced.

As described above, the almular is configured with a crescent piercing plate and a crescent plate which has no electrical engagement with the wire and the crescent plate is electrical connected with the crescent piercing plate only. In case a poor electrical engagement between the crescent piercing plate and the crescent plate is encountered which is resulted from manufacturing error, a poor electrical contact or open circuit will also be encountered when the resilient conducting rod is pressed against with the crescent plate.

SUMMARY OF THE INVENTION

It is the objective of this invention to provide a rotational jack socket assembly wherein the poor electrical contact between conventional resilient conducting rod and the annular conductor can be completely avoided. All the inconvenience encountered by the conventional jack socket call be completely solved by the present invention.

In order to achieve the object set forth, the rotational jack socket assembly made according to the present invention generally comprises a housing which has a jack socket rotationally mounted therein. The jack socket is provided with a receptacle for receiving and retaining a jack thereof. The bottom of the housing is attached with a mounting bracket. The outer peripheral wall of the jack socket is alternatively enveloped with an annular terminal and an insulator. The housing is provided with a plurality of retaining holes which are corresponding to each of the annular terminals. Each of the retaining holes is further mounted with a resilient conducting loop which is provided with a plurality of projections which direct radially and inward. When each of the conducting loop is enveloped onto the outer peripheral of the housing, each of the projections can be suitably positioned within a corresponding retaining hole such that the projection is electrically contacted with the outer peripheral of the annular terminal. By this arrangement, even the jack socket is rotated, the resilient conducting loop is electrically contacted with the annular terminal. The annular ring has a continuous contour without any gap such that the poor contact can be completely avoided.

According to another aspect of the present invention, wherein each of the projections of the resilient conducting loop is electrically contacted with the conducting ring of the annular terminal in a full-time manner. As a result, the poor electrical contact or open circuit encountered by the conventional annular conductor and the resilient conducting rod is completely solved. Besides, the improper electrical engagement between the crescent piercing plate and the crescent plate can also be solved by the provision of the conducting loop and the annular terminal.

According to the other aspect of the present invention wherein the annular terminal is provided with a conducting ring which has a continuous contour such that the poor contact resulted form a discontinuous contour can be completely avoided.

BRIEF DESCRIPTION OF DRAWINGS

In order that the present invention may more readily be understood the following description is given, merely by way of example with reference to the accompanying drawings, in which.

DETAILED DESCRIPTION OF PREFERRED EMBODIMENT

Figure 1:
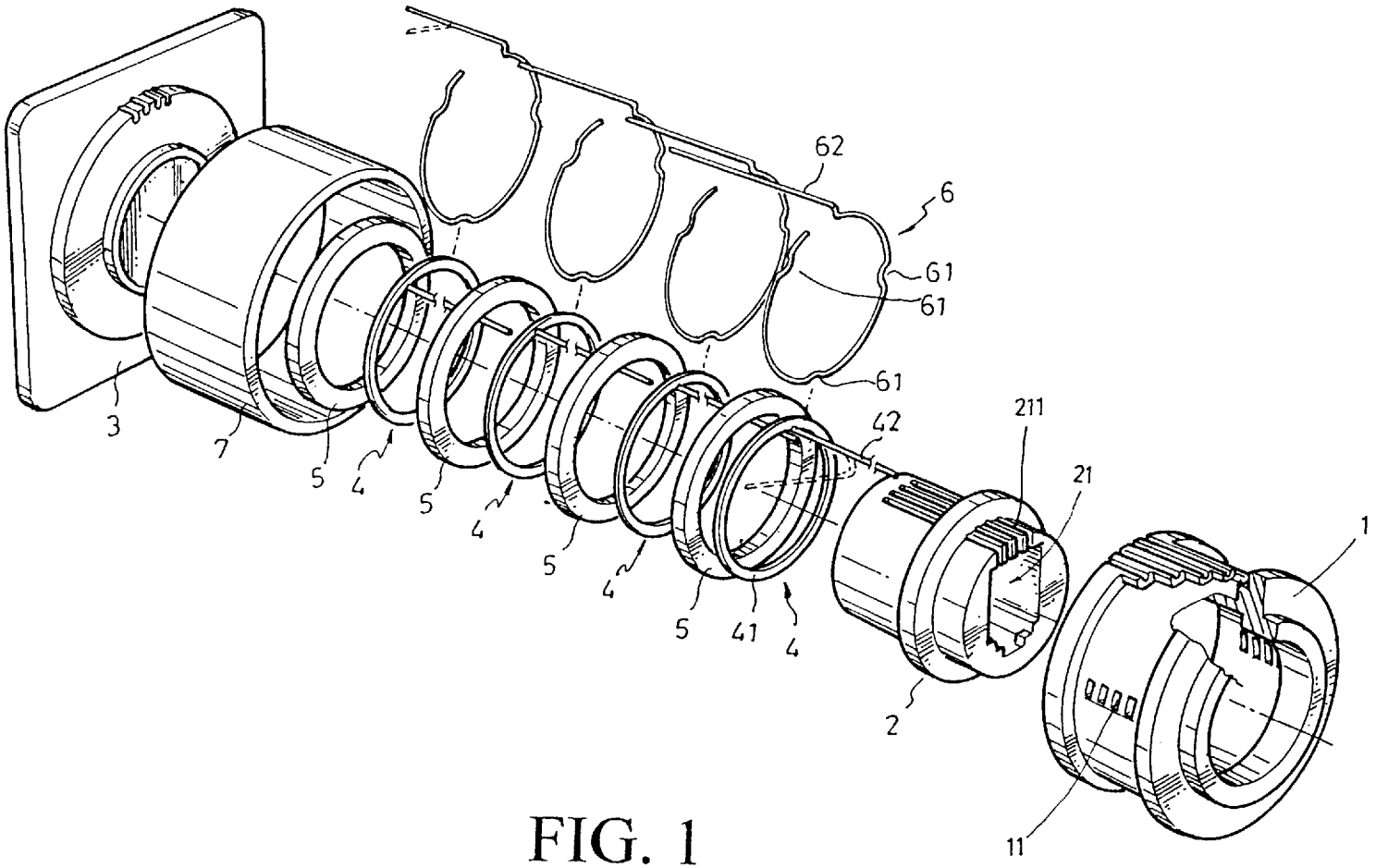
FIG. 1 is an exploded perspective of the jack socket assembly made according to the present invention.
Figure 2:
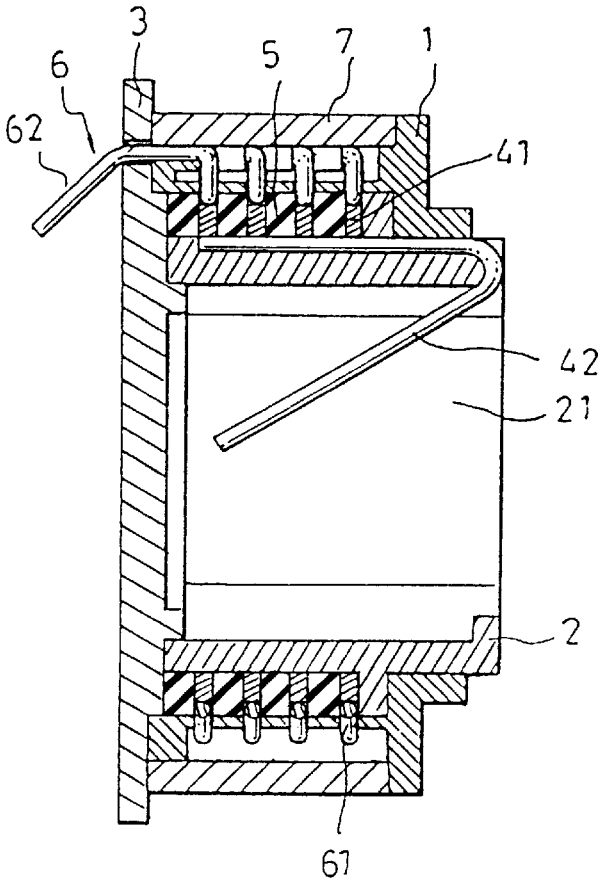
FIG. 2 is a cross sectional view of the jack socket assembly shown in FIG. 1.

Referring to FIGS. 1 and 2, the jack socket assembly made according to the present invention generally comprises a housing 1 having a jack socket 2 which is rotationally mounted therein. The jack socket 2 is provided with a receptacle 21 for receiving and retaining a jack (not shown) thereof. The receptacle 21 is farther provided with a plurality of positioning grooves 211. The bottom of the housing 1 is attached with a mounting bracket 3. The outer peripheral wall of the jack socket 2 is alternatively enveloped with an annular terminal 4 and an insulator 5. The annular terminal 4 is configured by a conducting ring 41 and a conducting finger 42. Each of the conducting fingers 42 is firstly positioned within the positioning groove 211 of the receptacle 21 and then the tip of the finger 42 is further bent inward and downward to the receptacle 21.

The housing 1 is also provided with a plurality of retaining holes 11 which are corresponding to each of the annular terminals 4. Each of the retaining holes 11 is further mounted with a resilient conducting loop 6 which is provided with a plurality of projections 61 which direct radially and inward. The conducting loop 6 is further provided with a conducting leg 62 which directs vertically. When each of the conducting loop 6 is enveloped onto the outer peripheral of the housing 1, each of the projections 61 can be suitably positioned within a corresponding retaining hole 11 such that the projection 61 is electrically contacted with the outer peripheral of the annular terminal 4. By this arrangement, even the jack socket 2 is rotated, the resilient conducting loop 6 is electrically contacted with the annular terminal 4. On the other hand, the housing 1 is further enveloped with an outer shell 7 with which the resilient conducting loops 6 are suitably enclosed and sandwiched between the outer shell 7 and the housing 1.

Figure 3:
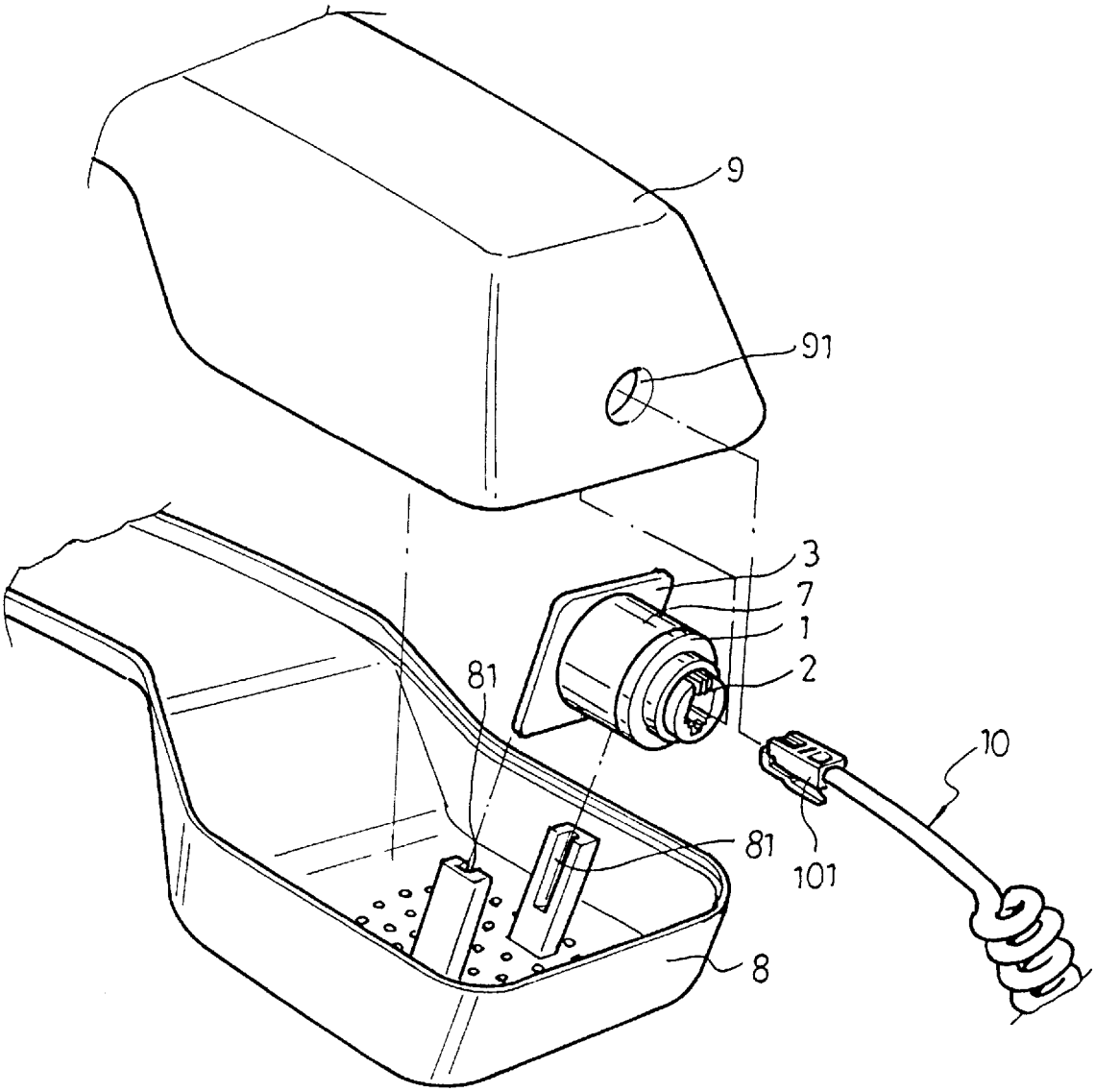
FIG. 3 is a perspective view of the jack socket assembly which has been mounted at the handset.
Figure 5:
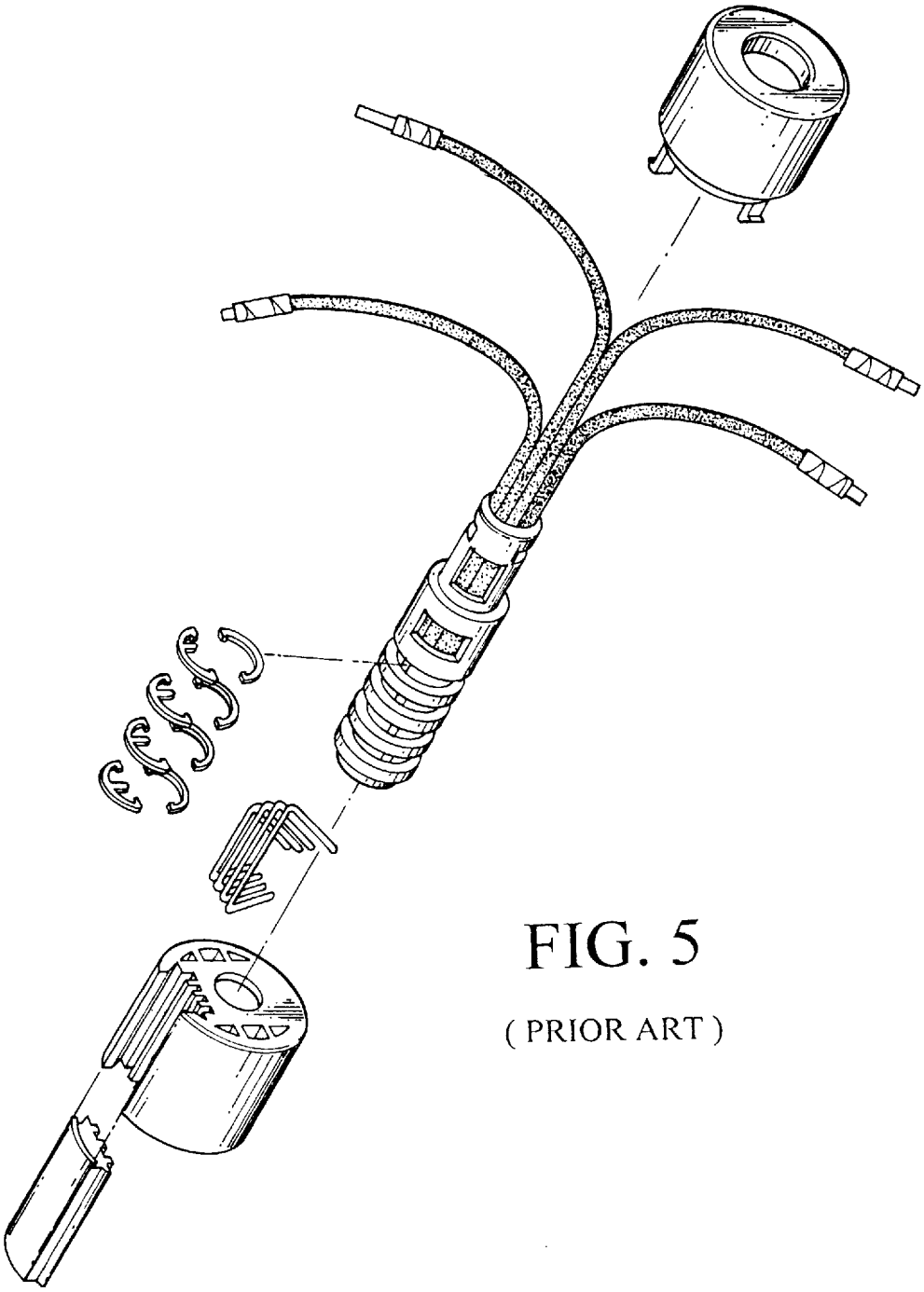
FIG. 5 ( PRIOR ART )
FIG. 5 is an exploded perspective view of a conventional jack socket.
Figure 6:
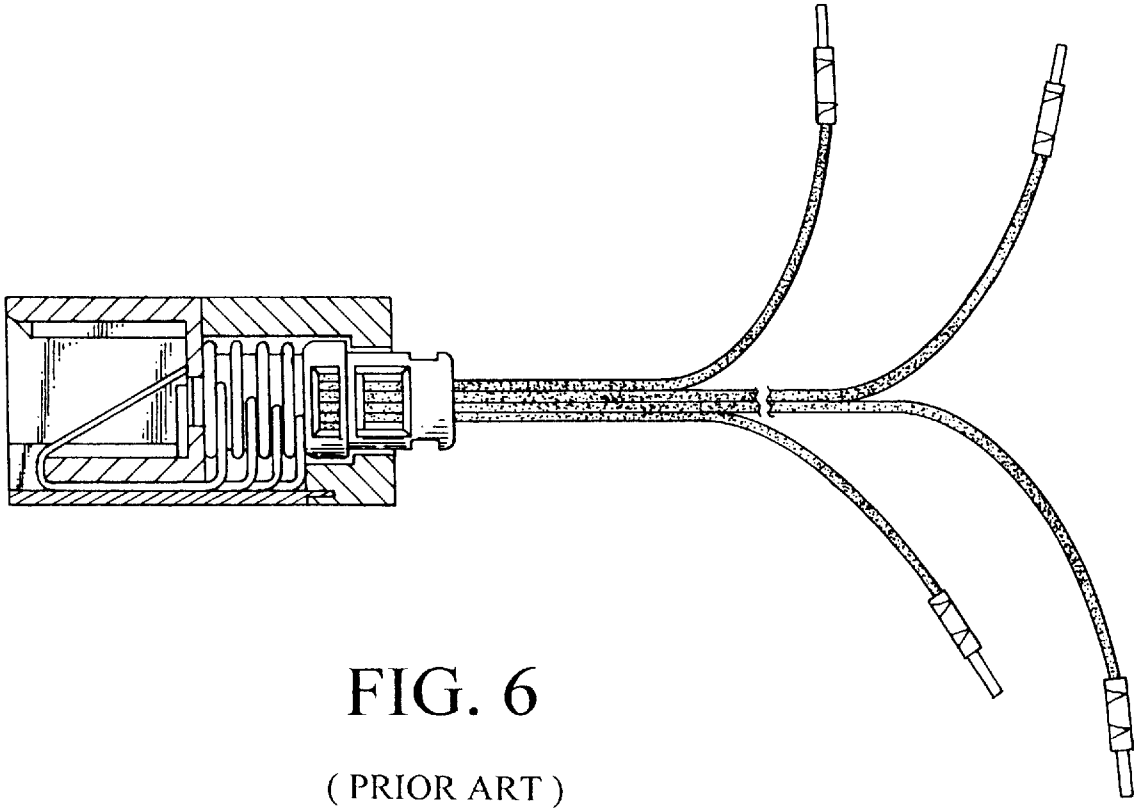
FIG. 6 ( PRIOR ART )
FIG. 6 is a cross sectional view of the jack socket shown in FIG. 5.

As clearly shown in FIG. 3, the mounting bracket 3 can be fixedly retained within the mounting groove 81 of the handset 8 firstly. Then the jack socket 2 is rotationally inserted into the central hole 91 of the upper shell 9. Afterward, the jack 101 of the handset cord 10 can be conductively inserted into the receptacle 21 of the jack socket 2. Since the jack 101 of the handset cord 10 is rotationally inserted within the jack socket 2, accordingly, when the handset cord 10 is twisted, by the rotation of the jack socket 2 within the housing 1, the twist can be readily released.

Figure 4:
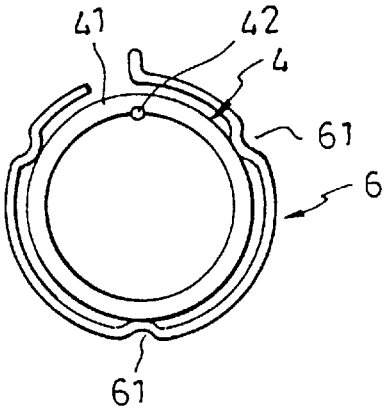
FIG. 4 shows detail structure of conducting loop and annular terminal of the present invention.

On the other hand, since the annular terminal 4 is fixedly attached to the jack socket 2 and which is provided with a conducting finger 42 which can be electrically conducted with the metal portion of the jack 101. Furthermore, the resilient conducting loop 6 is also fixedly mounted onto the housing 1 which is compressed radially and inward by the potential resilience thereof. As a result, the projections 61 of the resilient conducting loop 6 will establish a full-time, multi-point electrical contact with the peripheral of the conducting ring 41 of the annular terminal 4, as clearly shown in FIG. 4. As a result, no matter how the jack socket 2 is rotated, at least one of the projections 61 of the conducting loop 6 may have a electric contact with the conducting ring 41 of the annular terminal 4. Accordingly, the signal communicating therebetween can be kept always no matter how the jack socket 2 is rotated, shifted or even offset. Besides, the conducting ring 41 of the annular terminal 4 has a continuous contour. The electrical contact between the conducting ring 41 of the annular terminal 4 and the projection 61 of the resilient conducting loop 6 can be therefore kept constantly and which is irrelevant to the rotation of the jack socket 2. As a result, the communicating quality can be therefore ensured.

I claim:

1. A rotational jack socket assembly, comprising a housing having a jack socket which is rotationally mounted therein, said jack socket being provided with a receptacle for receiving and retaining a jack thereof, said receptacle being further provided with a plurality of positioning grooves, the bottom of said housing being attached with a mounting bracket, the outer peripheral wall of said jack socket being alternatively enveloped with an annular terminal and an insulator, said annular terminal being configured by a conducting ring and a conducting finger which can be positioned within said positioning groove of said receptacle and then the tip of said finger being bent inward and downward to said receptacle, said housing being also provided with a plurality of retaining holes which are corresponding to each of said annular terminals, each of said retaining holes being further mounted with a resilient conducting loop which is provided with a plurality of projections which direct radially and inward, said conducting loop being further provided with a conducting leg which directs vertically and extends beyond said mounting bracket, wherein when each of said conducting loop is enveloped onto the outer peripheral of said housing, each of said projections can be suitably positioned within a corresponding retaining hole such that said projection is electrically contacted with the outer peripheral of said annular terminal, said housing being further enveloped with an outer shell with which said resilient conducting loops are suitably enclosed and sandwiched between said outer shell and said housing.

* * * * *